US006279204B1

(12) United States Patent
Gonzalez

(10) Patent No.: US 6,279,204 B1
(45) Date of Patent: Aug. 28, 2001

(54) HANG-A-CHIP

(76) Inventor: Gonzalo Fernando Gonzalez, 6330 SW. 7th St., Margate, FL (US) 33068

( * ) Notice: Subject to any disclaimer, the term of this patent is extended or adjusted under 35 U.S.C. 154(b) by 0 days.

(21) Appl. No.: 09/417,624

(22) Filed: Oct. 14, 1999

(51) Int. Cl.[7] ..... B65D 33/00; B65D 77/10; A47B 96/06

(52) U.S. Cl. ..... 24/30.5 R; 24/16 R; 24/30.5 P; 24/543

(58) Field of Search ..... 24/16 R, 30.5 P, 24/543, 716; 248/231.8

(56) References Cited

U.S. PATENT DOCUMENTS

| | | | | |
|---|---|---|---|---|
| 3,407,425 | * | 10/1968 | Drumm | 24/16 R |
| 4,534,089 | * | 8/1985 | Swan | 24/30.5 P |
| 5,305,500 | | 4/1994 | Tucker | 24/30.5 R |
| 5,337,987 | | 8/1994 | Sawatsky | 248/231.8 |
| 5,379,489 | | 1/1995 | Delk et al. | 24/30.5 R |
| 5,428,871 | * | 7/1995 | Iosif | 24/30.5 P |
| 5,598,608 | | 2/1997 | Naslund | 24/30.5 R |

FOREIGN PATENT DOCUMENTS

| | | | | |
|---|---|---|---|---|
| 2158141 | * | 11/1985 | (GB) | 24/16 R |
| 2229491 | * | 9/1990 | (GB) | 24/16 R |

* cited by examiner

*Primary Examiner*—Victor N. Sakran
(74) *Attorney, Agent, or Firm*—Patent & Trademark Services; Thomas Zack; Joseph H. McGlynn

(57) ABSTRACT

A combined clip retaining bracket and bag retaining clip. Several channels are formed in the bracket each having a lower opened slot extending the length of the bracket. A clip with two legs pivotally connected together at one of their ends is inserted pivot end first into each of the channels. Along the two facing side surfaces of the clip are a sealing strip and a mating groove used to seal the opened top edge of any bag inserted between them. Any food products, like potato chips, whose bags need resealing may be hung from the clips retained by the bracket's channels. To insure the clips are pressed together properly, the width of the channel is just slightly greater than the total width of the inserted clip. The two legs of the clips are substantially the same length and the channel may have a closed and opened front end.

5 Claims, 4 Drawing Sheets

HANG-A-CHIP

BACKGROUND OF THE INVENTION

This invention relates to a clip used to hold bags of chips that have previously been opened or not by the user after packaging and then resealed for storage, in a functional and space saving way making them easy to identify and access.

Clips of different configurations have been to reseal bags with storageable foods for many years. One of the most common types of bag clips uses two leg members that pivot relative to each other with a biasing spring between them to normally maintain the legs together at their free ends.

Still another bag clip configuration used two elongated jaws and a first spring portion that is used to bias the front ends of the jaws towards each other. An elongated second spring on the front end of the second jaw extends inwardly towards the first spring to bias the front end of the second jaw towards the front of the first jaw portion.

Another prior art reference discloses an article storage organizer including a mounting track and clips slidably received within a channel of the track. The clips are pivotable between an opened and a closed position relative to the track. With another invention a bag closure for sealing bags is described that has a trough which engages a blade like body of a wedge-shaped member. The upper end of the blade-like member has a location for receiving a bag which can be clamped between this member and the trough.

Still another bag clip invention for sealing bags includes two hinged limbs with bag engagement surfaces. There is a snap lock at the limbs free ends and an elastically resilient bridge to press bag material against an engagement surface.

DESCRIPTION OF THE PRIOR ART

Bag closure or sealing clips are known. For example, in the U.S. Pat. No. 5,305,500 to Tucker two elongated jaws and a first spring portion are used to bias the front ends of the jaws towards each other. An elongated second spring on the front end of the second jaw extends inwardly towards the first spring to bias the front end of the second jaw towards the front of the first jaw portion.

U.S. Pat. No. 5,337,987 to Sawatsky discloses an article storage organizer including a mounting track and clips slidably received within a channel of the track. The clips are pivotable between an opened and a closed position relative to the track to retain bags.

U.S. Pat. No. 5,379,489 to Delk et al. discloses a bag closure for sealing bags that has a trough which engages a blade like body of a wedge-shaped member. The upper end of the blade-like member has a location for receiving a bag which bag can be clamped between this member and the trough.

U.S. Pat. No. 5,598,608 to Naslund discloses a bag clip invention for sealing bags which includes two hinged limbs with bag engagement surfaces. There is a snap lock at the limbs free ends and an elastically resilient bridge to press bag material against an engagement surface In the present invention a clip receptacle mounted on a supporting surface has spaced channels each of which channels can receive a pivotably mounted clip to retain a sealed bag in each channel as set forth hereafter.

SUMMARY OF THE INVENTION

This invention relates to mounting bracket with spaced channels each of which can receive a pivotably mounted bag clip.

It is the primary object of the present invention to provide for an improved mounting bracket and bag clip to retained and seal bags, organizing them in a functional and space saving way making them easy to identify and access.

Another object is to provide for such a system wherein a plurality of spaced channels within a mounting bracket each may have bag sealing clips mounted in them.

These and other objects and advantages of the present invention will become apparent to readers from a consideration of the ensuing description and the accompanying drawings.

DESCRIPTION OF THE PREFERRED EMBODIMENT

Figure 1:
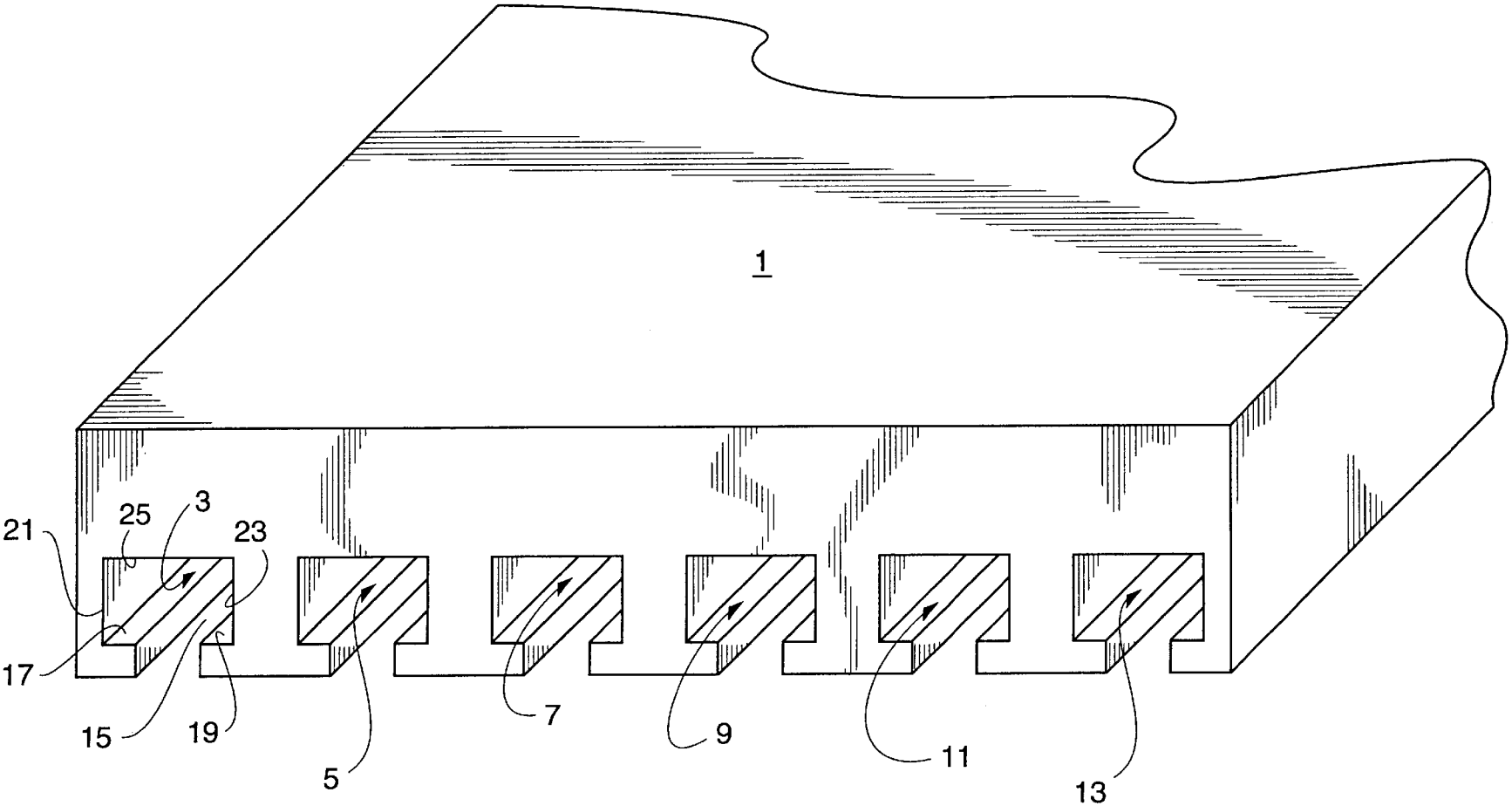
FIG. 1 is a perspective view of the mounting bracket used in the present invention.

FIG. 1 is a perspective view of the mounting bracket 1 used in the present invention. The bracket has several, six shown, formed identical bracket tracks or channels, 3,5,7, 9,11 and 13 which are spaced apart from each other and extend parallel to each other into the body of the bracket 1. Each channel is opened at one end and may be closed or opened at the other end and has a lower opened center slot 15 (e.g. see channel 3) which extends all or most of the length of the channel. Two lower inwardly facing leg tracks 17 and 19 extend along all or most of the bottom surface of the channel and are spaced from each other the width of the slot and are on both sides of the slot 15. The lower leg tracks 17 and 19 act as supporting lower surfaces for a bag retaining clip (see FIGS. 3–4) to be separately inserted into each of the individual channels (3–13). Two opposite side surfaces 21 and 23 extend along all or most of the length of the formed channels to laterally support the inserted clip. A top surface 25 also extends along the length of each formed channel. The exact number of parallel channels formed in the body of the bracket 1 can vary as desired. The bracket 1 may be mounted at its top surface by screws, bolts, nails, bonding material, etc. to any rigid support, such as the underside of a cabinet.

Figure 2B:
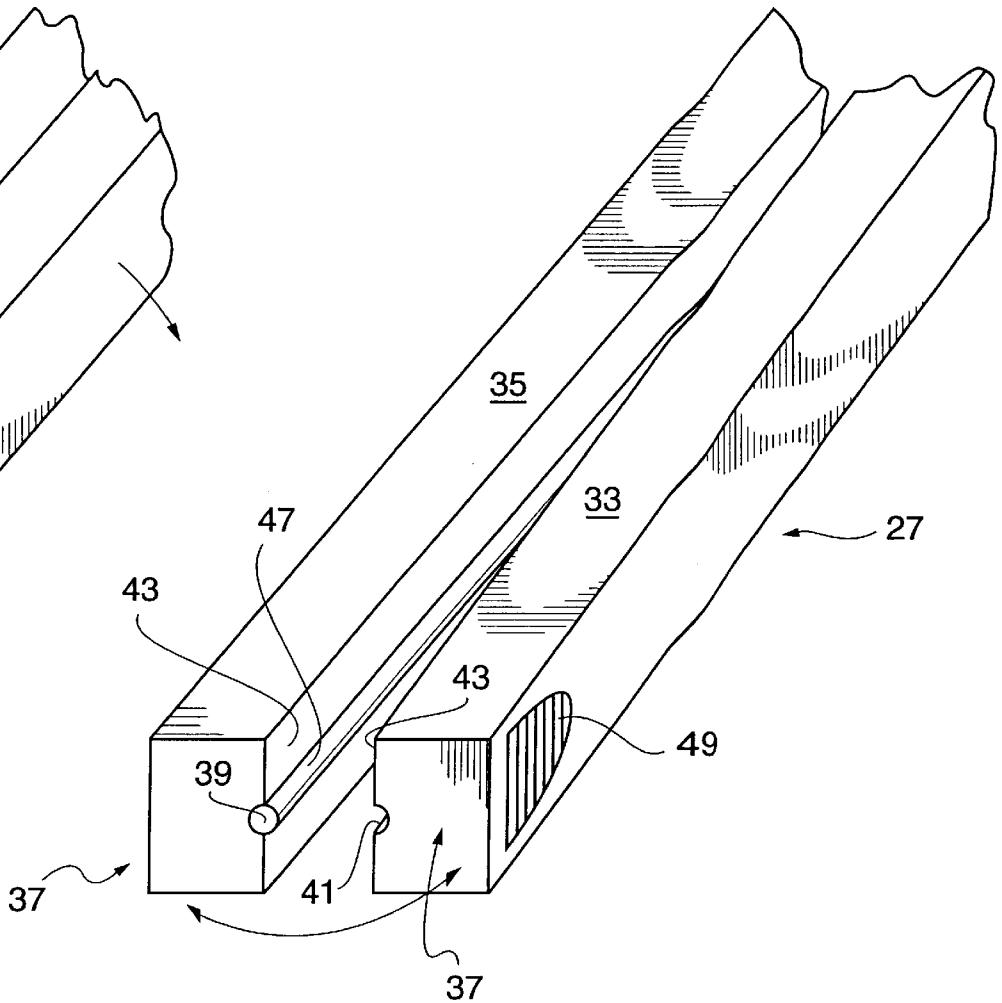
FIG. 2(*a*) is a perspective view of one end of the bag clip used in the mounting bracket of FIG. 1 and FIG. 2(*b*) is a perspective view of the opposite end of the same bag clip.
Figure 2A:
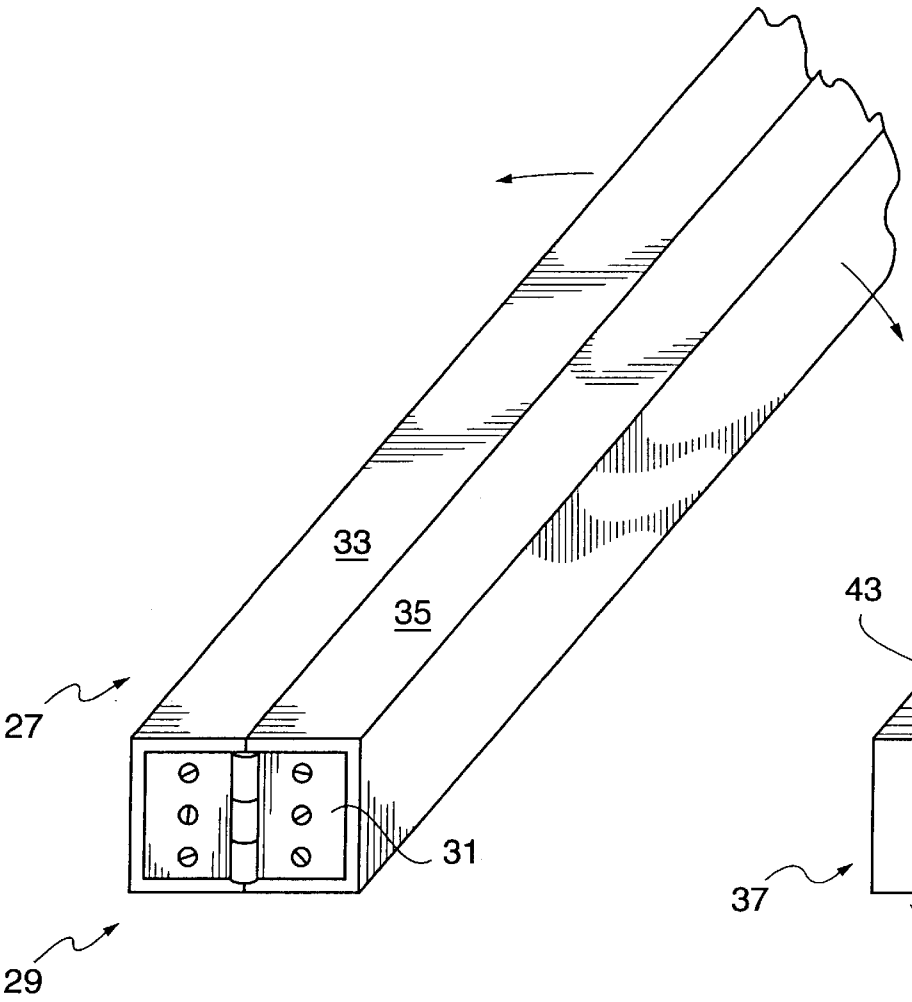

FIG. 2(*a*) is a perspective view of one end of the bag clips 27 used with the mounting bracket 1 of FIG. 1. Each of the clips 27 is inserted in a slidable manner into each of the formed bracket channels of FIG. 1 with the hinged side 29 first. Hinge 31 joins the two ends of each of two equal length leg members 33 and 35 together such that the opposite leg free ends, see FIG. 2(*b*), may pivot outwardly and apart. Any type of pivot joint may be used to retain one end of each leg together.

FIG. 2(*b*) is a perspective view of the opposite end of the same bag clip and now shows the legs 33 and 35 on opposite sides with the free ends of the legs 37 pulled slightly apart. Two facing semi-circular grooves 39 and 41 run along the inner facing surfaces 43 and 45 of each leg 33 and 35. One of the two facing grooves 39, has an elongated cylindrically shaped foam strip 47 bonded to the groove 39 along its length with an exposed exterior surface of the strip extending towards and complementarily engageable with the opposite leg groove 41. A side finger roughened surface area or surface serrations (one of the two shown) 49 is located near the free ends of the legs 33 and 35 and is used to hold the free ends of the two legs 33 and 35 together before the top opened edge of a bag has inserted between the legs and before the clip 27 is slidably inserted into a bracket channel slot. When the bag retaining clip is inserted into a channel, its foam strip 47 is pressed against the bag's sides below the bag's opened top and this strip is also pressed into the mating groove 41 with the bag sides in the same groove 41. This mating action of strip and groove provides for an air tight seal to retain freshest to any food products, like potato chips, etc., stored within a mounted bag.

Figure 3:
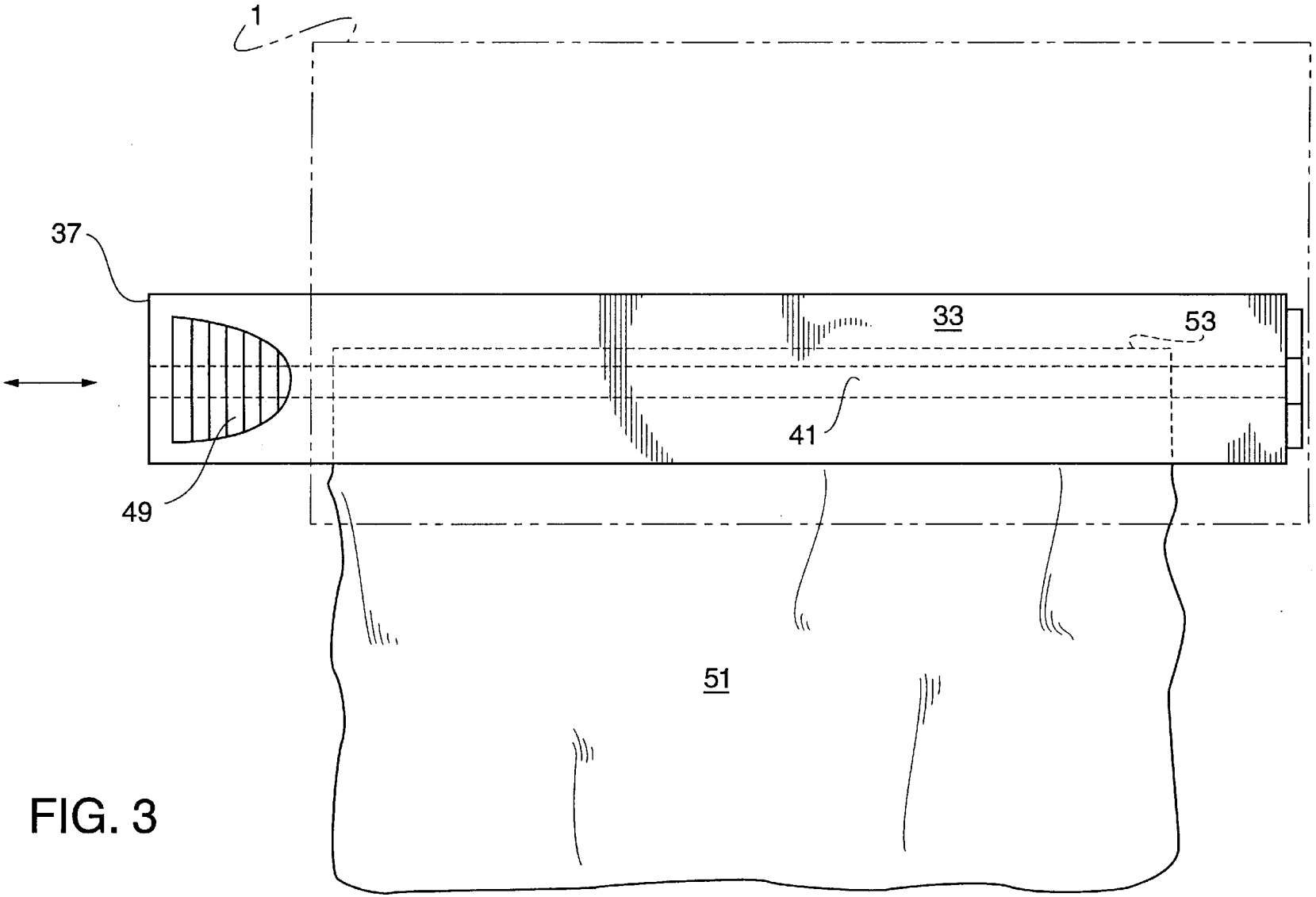
FIG. 3 is a side view of the bag clip with a depending bag of retained and sealed food products.

FIG. 3 is a side view of the bag clip with a depending plastic bag 51 of retained and sealed food products. This is an example of how the clip is used in conjunction with the mounting bracket 1, shown in dotted line format, with the two legs of the clip having been inserted pivotally connected end first into one of the opened bracket channels shown in FIG. 1. The top opened edge of the bag 53 and the opening is slightly above the facing leg grooves 39 and 41 while the sealing strip 47 is press fitted into the groove 41. This provides for an air tight seal of the opened top of the bag. Clearly, the dimensions for the channel, especially, the distances between the opposite facing side wall surfaces 23 and 25 are chosen to be just slightly greater than total width of the two legs 33 and 35 to permit the legs to be snugly inserted into the channel and also to tightly squeeze the mounted legs together. When it is desired to use the contents of the bag 51, a user simply pulls on the free clip end area 49 to the left in FIG. 3 to withdraw the inserted clip 27 from its supporting bracket 1 and then spreads the two clip legs 33 and 35 apart to release the bag from the retaining clip 27.

Figure 4:
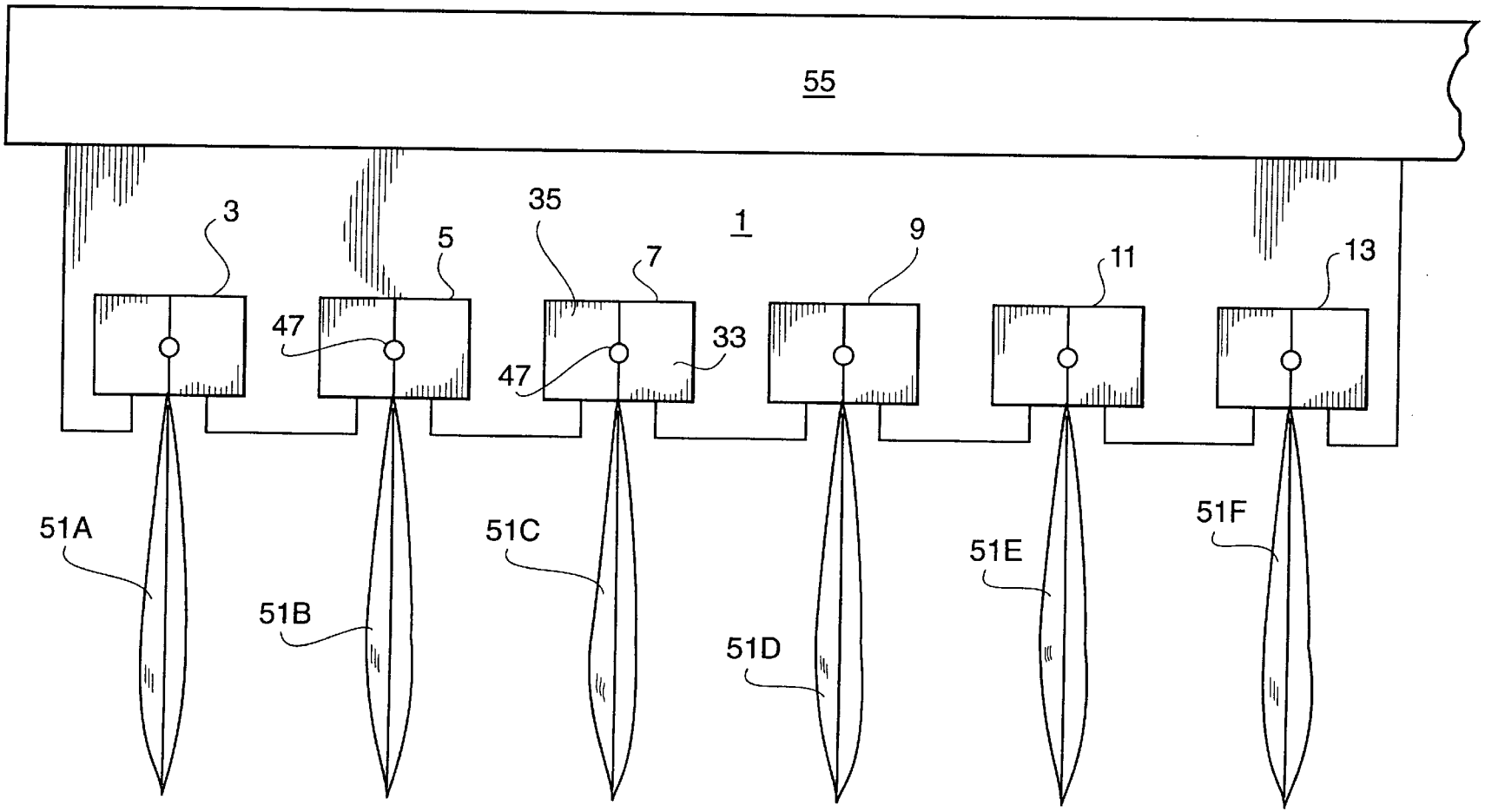
FIG. 4 is a front view of the mounting bracket with a plurality of bag clips and retaining food product bags.

FIG. 4 is a front view of the mounting bracket with a plurality of inserted bag clips 27 and six bracket depending retaining lower food product bags 51A–51F. As in FIG. 3, each of these bags and their associated clips have been inserted into a separate channel in the bracket 1 with their pivoted connected ends first. The sealing strips 47 are pressed into the mating leg grooves 41 just below and along the opened top ends of each bag. Above the bracket 1 is the rigid supporting structure of the cabinet 55 to which the bracket is fixed.

All or most of the components for the bracket 1 and the inserted clips 27 should be made of a light weight and inexpensive to manufacture material, such as plastic. The particular dimensions of the bracket and their retained clips depends on their intended use. Thus, for plastic bags containing heavy food products, like unpeeled potatoes, the brackets and clips would be more massive and stronger than those used with bags for lighter weight and less massive items like potato chips,taco chips, etc. Clearly, the particular items that are contained within the depending bags 51 can vary. Also any food product that needs to have its contents sealed from the outside can be stored. In fact it is not absolutely essential that the bag contain food products only products that need to be protected.

With the described embodiment of the invention many sealed bags can be conveniently stored while their contents are sealed from the environment. Other supporting surfaces in addition to kitchen cabinets may be used to support the bracket 1, as long as there is sufficient space to hand the bags underneath.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What claim as my invention is:

1. A combined bracket and bag retaining clip comprising:

a bracket having a length with a plurality of channels extending substantially the entire length of said bracket, each of said channels having a lower opened slot extending lengthwise of the bracket; and a bag retaining clip insertable into at least one of the channels of said bracket to retain a depending bag through the lower opened slot of the channel into which it is inserted, said clip having two leg members joined together near one of their ends by a pivotal connection, and wherein one of said two leg members has a length with a flexible sealing strip extending substantially the length of the leg member, and the other of said two leg members has a mating groove to engage the sealing strip.

2. The combination as claimed in claim 1, wherein said two leg members are joined together by an end hinge to form said pivotal connection.

3. The combination as claimed in claim 2, wherein each of said bracket channels has opposed lower leg surfaces on each side of the opened slot.

4. The combination as claimed in claim 3, wherein each of said channels and the clip have a width which widths are substantially the same to provide a snug fit when the clip is inserted into the channel.

5. The combination as claimed in claim 4, wherein there are a plurality of bag retaining clips equal in number to the number of bracket channels.

* * * * *